US007401363B2

(12) United States Patent
Hatfield et al.

(10) Patent No.: US 7,401,363 B2
(45) Date of Patent: Jul. 22, 2008

(54) ADJUSTABLE CONCEALED BODY ARMOR

(75) Inventors: Sandra Leigh Hatfield, Lighthouse Point, FL (US); Ronda Renee Graves, Coconut Creek, FL (US); Wayne Kolbeck, Boynton Beach, FL (US)

(73) Assignee: Point Blank Body Armor, Inc., Pompano Beach, FL (US)

( * ) Notice: Subject to any disclaimer, the term of this patent is extended or adjusted under 35 U.S.C. 154(b) by 0 days.

(21) Appl. No.: 10/644,552

(22) Filed: Aug. 19, 2003

(65) Prior Publication Data

US 2005/0193481 A1 Sep. 8, 2005

Related U.S. Application Data

(60) Provisional application No. 60/404,435, filed on Aug. 19, 2002.

(51) Int. Cl.
*F41H 1/02* (2006.01)

(52) U.S. Cl. ..... 2/2.5

(58) Field of Classification Search ..... 2/2.5, 2/102, 96, 97, 94, 247, 462, 464, 467; 428/911; 89/36.01, 36.02, 36.05
See application file for complete search history.

(56) References Cited

U.S. PATENT DOCUMENTS 3,803,639 A * 4/1974 Cohen ..... 2/2.5
5,060,314 A * 10/1991 Lewis ..... 2/2.5
5,331,683 A * 7/1994 Stone et al. ..... 2/2.5
5,373,582 A 12/1994 Dragone et al.
5,530,966 A * 7/1996 West ..... 2/462
6,185,738 B1 * 2/2001 Sidebottom ..... 2/2.5
6,823,529 B1 * 11/2004 Dako ..... 2/2.5

* cited by examiner

*Primary Examiner*—Tejash Patel
(74) *Attorney, Agent, or Firm*—Holland & Knight LLP; Thomas M. Johnston, Esq.

(57) ABSTRACT

A body armor for protecting a user from penetration comprising: a front protective section for overlying the chest region of the user; a rear protective section for overlying the back of the user; a pair of flexible right and left shoulder straps fastened to right and left shoulder regions, respectively, of the rear section, wherein the straps extend over the right and left shoulders of the user for attachment to corresponding right and left portions of the front section; the shoulder straps include complete adjustability within an outer shell shoulder so as to be hidden within the outer shell shoulder, the shoulder strap is directly attached to a ballistic panel by stitching through the ballistic panel and the shoulder strap; and a stabilizer tab is directly sewn to the ballistic panel so as to stabilize the ballistic panel against the user's body.

6 Claims, 16 Drawing Sheets

ADJUSTABLE CONCEALED BODY ARMOR

CROSS-REFERENCE TO RELATED APPLICATIONS

This application claims the benefit under 35 U.S.C. 119(e) of U.S. Provisional Application Ser. No. 60/404,435, filed Aug. 19, 2002.

FIELD OF THE INVENTION

Various embodiments of the present invention relate to body armor. More particularly, to a body armor that the shoulder straps are concealed and include complete adjustability within the outer shell shoulder.

BACKGROUND OF THE INVENTION

Body armor have saved the lives of many law enforcement officers and military personnel in recent years. Body armor have been available in recent years as a protective panel having overlying layers of a fabric. The comfort of a body armor is an extremely important consideration because of the heat buildup that occurs from wearing a heavy and inflexible vest for the long hours an officer is on duty. In addition, concealing the body armor is another important consideration. Preventing "riding up" of the armor is yet another important consideration.

BRIEF DESCRIPTION OF THE DRAWINGS

The present invention will be more fully understood and further advantages will become apparent when reference is made to the following detailed description of the invention and the accompanying drawings. However, these figures are merely illustrative and are not meant to limit the embodiments of the invention.

FIG. 2A is a pattern drawing for an embodiments of the back outershell of the body armor of the present invention;

FIG. 8A is an illustration of the fragmentary view of FIG. 8 showing the hidden zipper and the opening for stabilizer tab pull through;

FIG. 10 is an illustration of the front view of one embodiment of the present invention showing the stabilizer tab when the outershell is closed and the tab is threaded through; FIG. 1A shows the outside front of the body armor, FIG. 11B shows the inside front of the body armor and FIG. 11C shows the outside back of the body armor.

DETAILED DESCRIPTION OF THE EMBODIMENTS

The present invention is described in relation to its use as a body armor having a front protective section for overlying the chest region of the user, and a rear protective section for overlying the back of a user. The front section includes a front protective panel. Similarly, the rear section includes a rear protective panel. A pair of flexible right and left straps 10 are fastened to right and left shoulder regions, respectively, of the rear section. The straps extend over the right and left shoulders of the user for attachment to corresponding right and left portions of the front jacket.

Figure 1A:
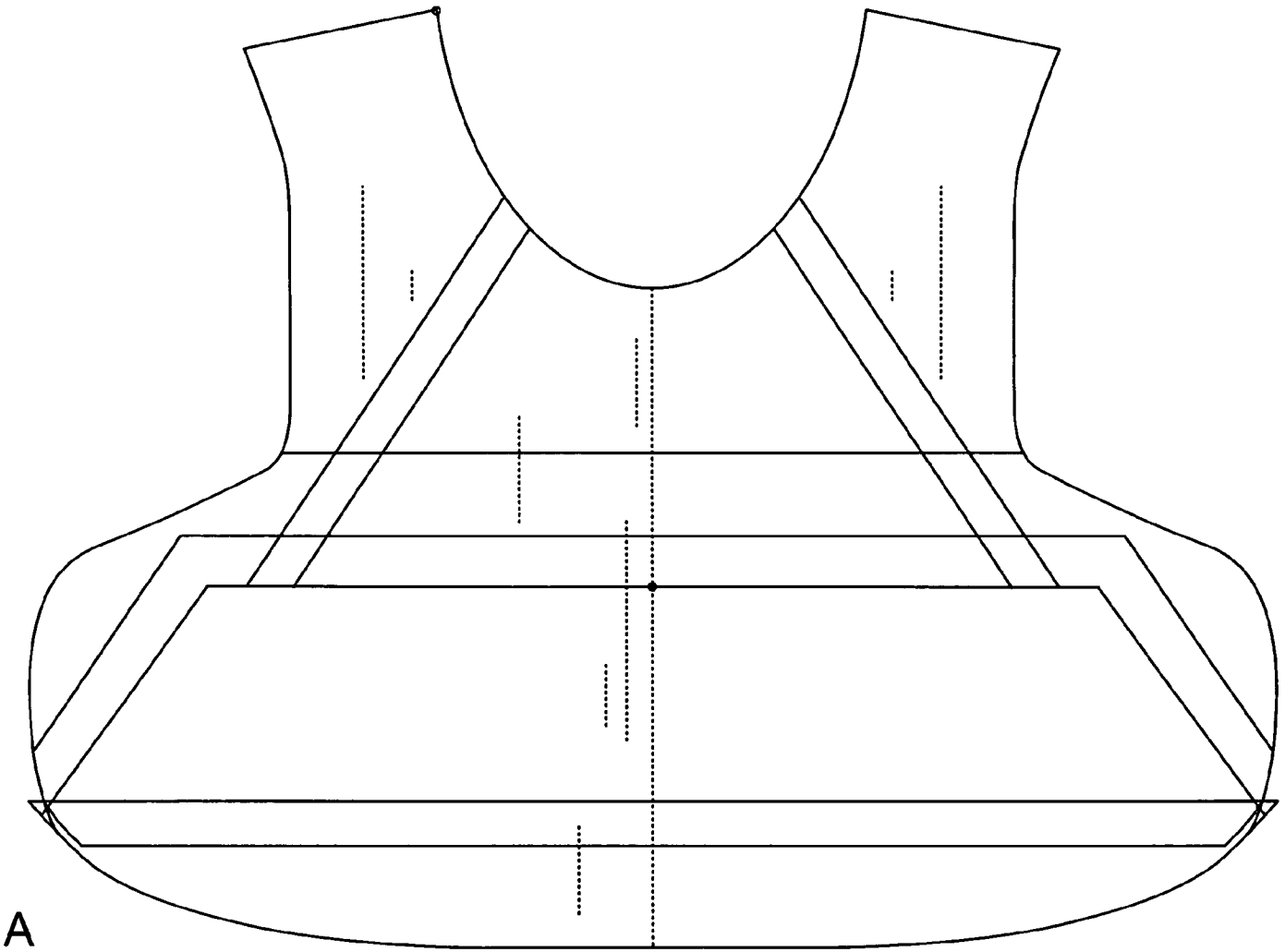
FIG. 1A is a pattern drawing for an embodiments of the front outershell of the body armor of the present invention.
Figure 1B:
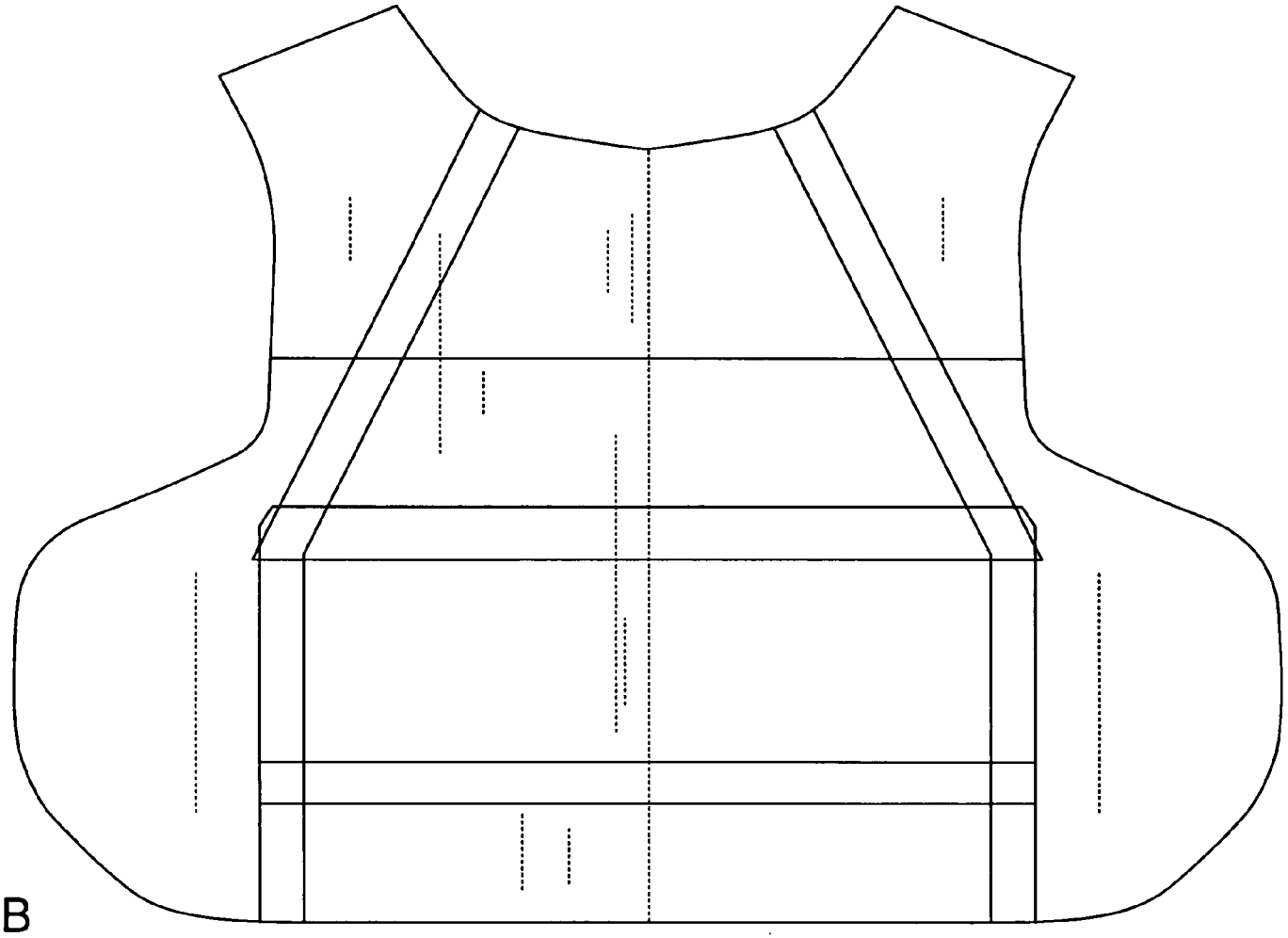
Figure 3A:
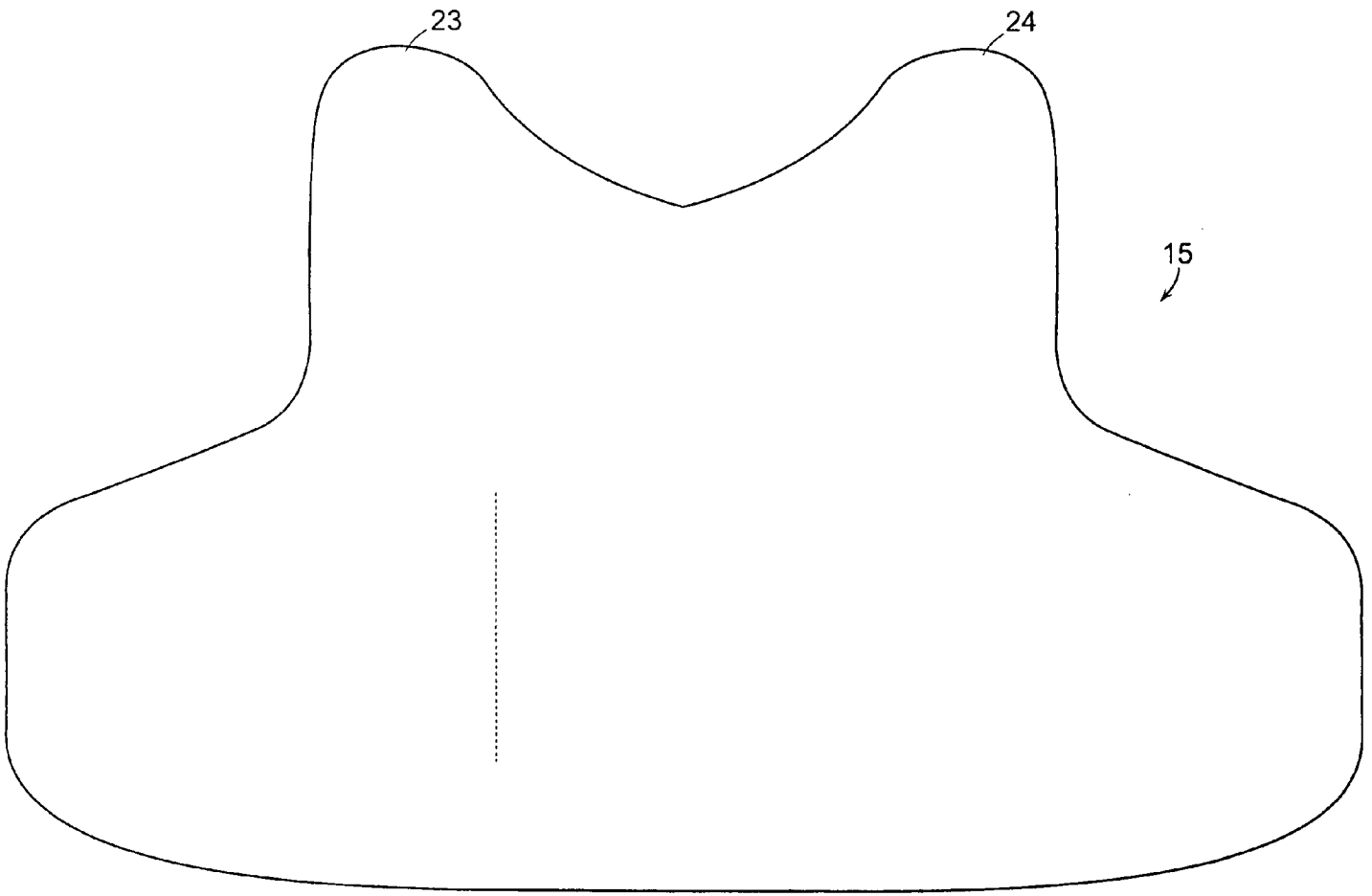
FIGS. 3A and 3B are pattern drawings for embodiments of the front ballastic panel and back ballastic panel respectively of the body armor of the present invention.
Figure 3B:
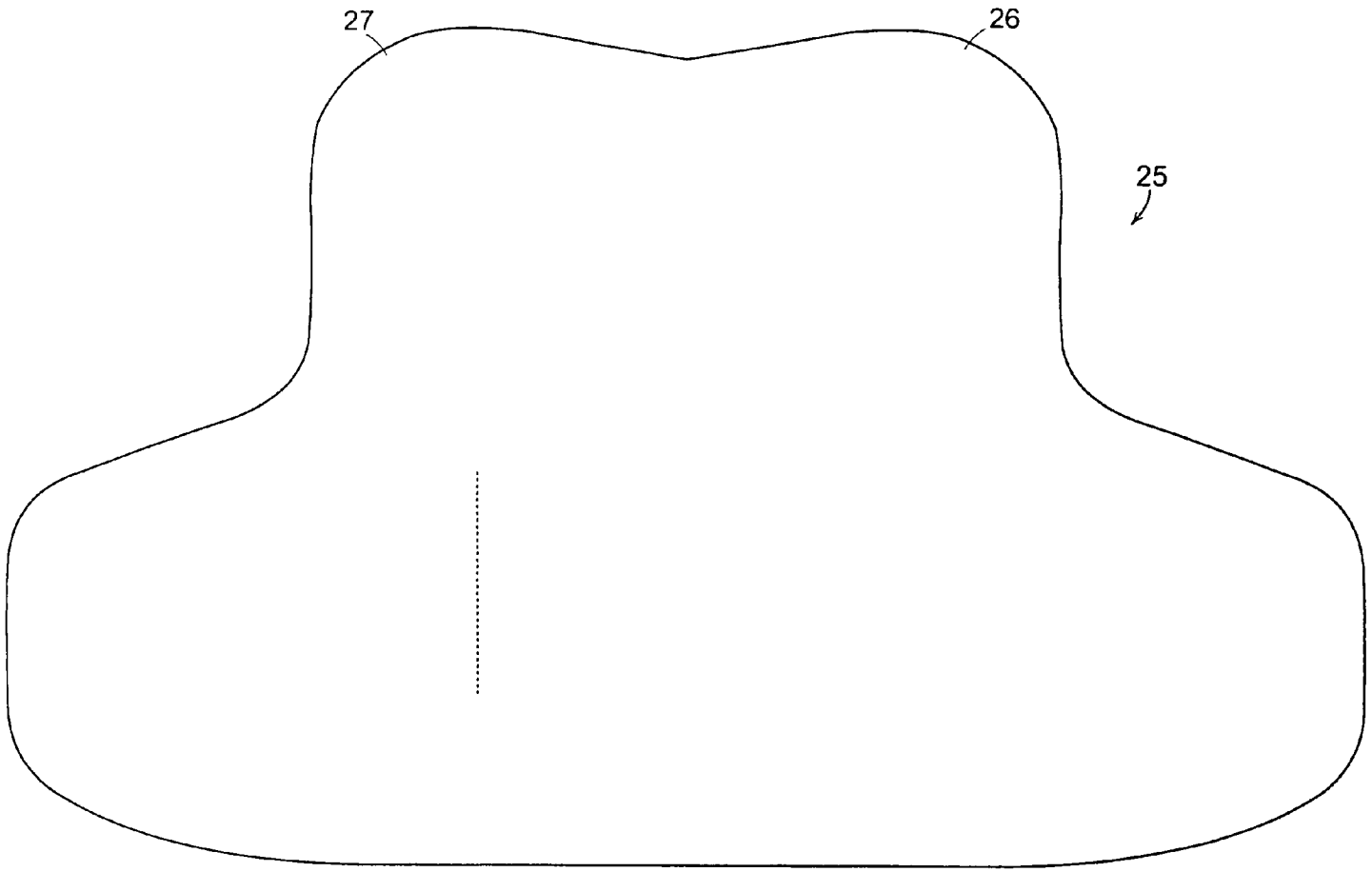
Figure 4A:
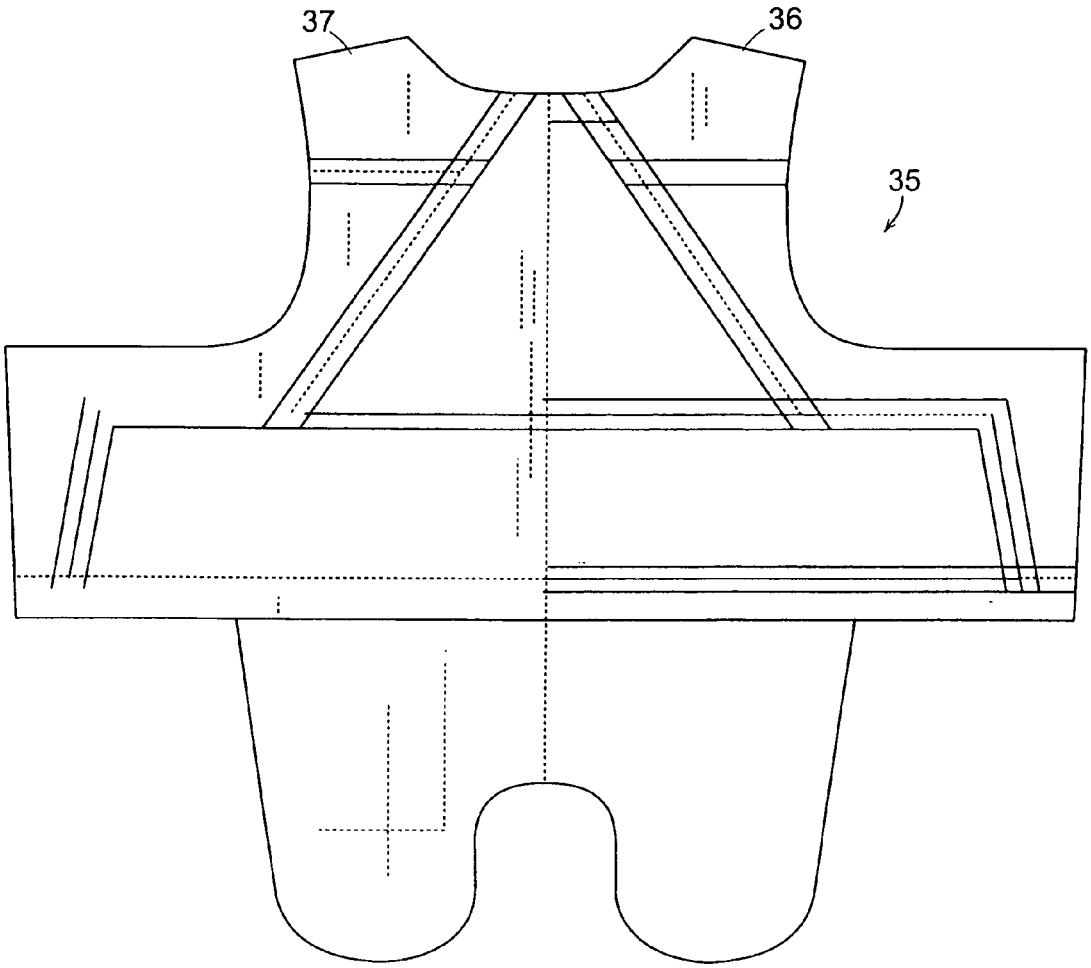
FIGS. 4A and 4B are pattern drawings for alternative embodiments of the outside back of the body armor of the present invention.
Figure 4B:
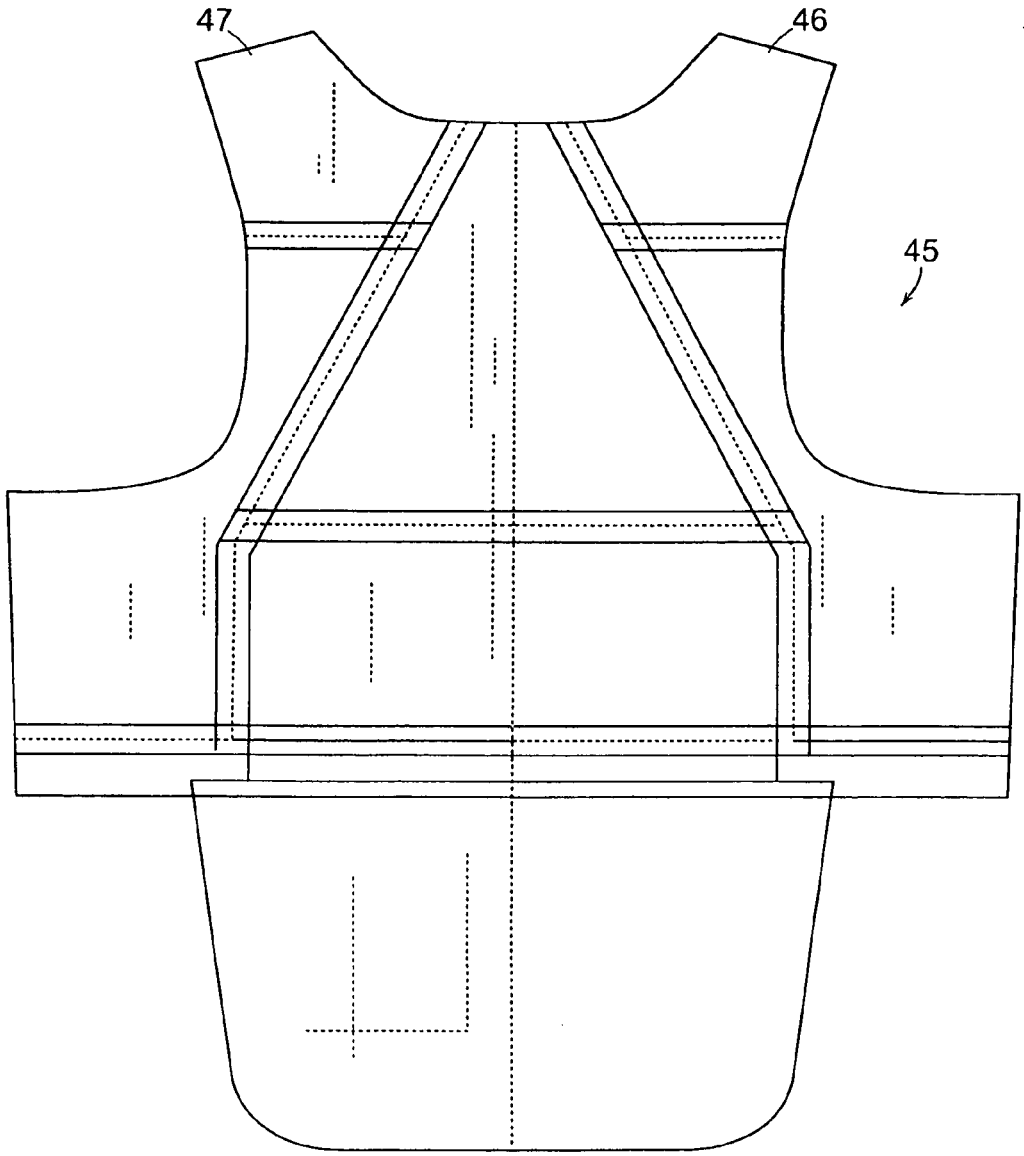

Referring to FIGS. 1A to 4B, various embodiments of outershells and ballistic panels are shown. Specifically, FIG. 1A depicts an embodiment of a front outershell 2. The front outershell includes a right front outershell shoulder area 3, which is on the right shoulder of a user when worn, and a left front outershell shoulder area 4. FIG. 2A depicts an embodiment of a rear outershell 5. The rear outershell 5 includes a right rear outershell shoulder are 6 and a left rear outershell shoulder area 7. Each of these outershells 2, 5 is configured to enable ballistic material or panels to be inserted within the outershells 2, 5. FIG. 4A depicts alternative embodiments of a rear outershell 35 that includes right rear outershell shoulder area 36 and a left rear outershell shoulder area 37. FIG. 4B depicts a further embodiment of a rear outershell 45 that includes right rear outershell shoulder area 46 and a left outershell shoulder area 47.

Referring to FIGS. 3A and 3B, an embodiment of a front ballistic panel 15 includes a right shoulder region 23 and a left shoulder region 24. Likewise, an embodiment of a rear ballistic panel 25 includes a right shoulder region 26 and a left shoulder region 27.

Figure 5:
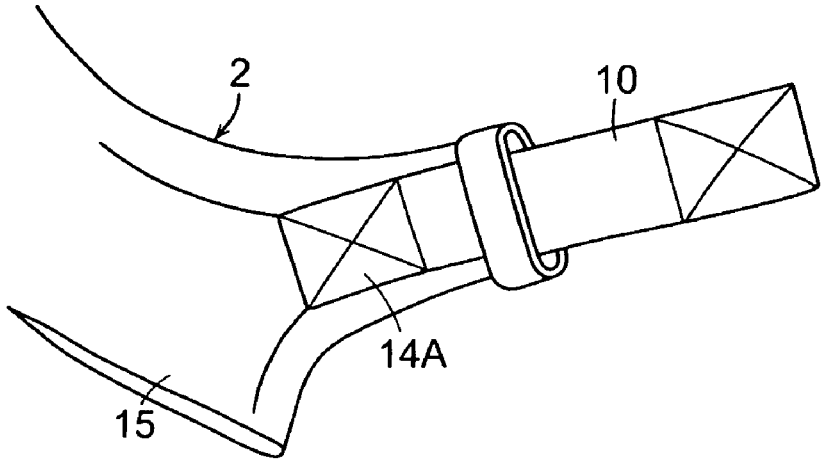
FIG. 5 is an illustration of the fragmentary sectional view of one embodiment of the concealed shoulder strap of the present invention.
Figure 5A:
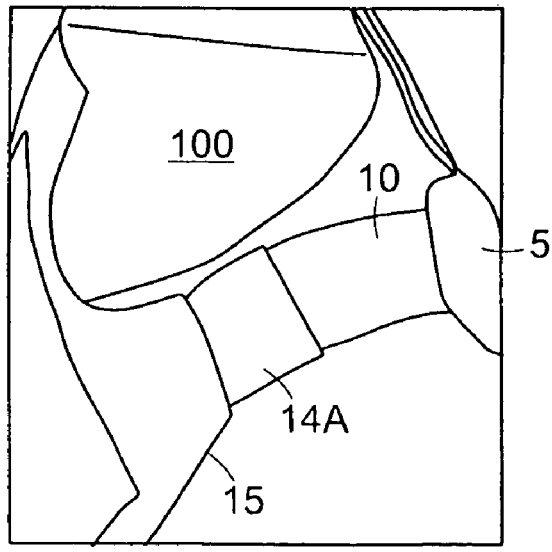
FIG. 5A is a perspective view of the embodiment of FIG. 5 on a user, with the front outershell removed.
Figure 6:
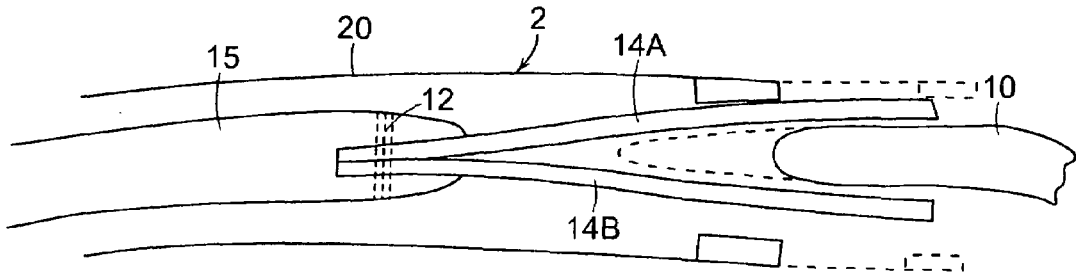
FIG. 6 is an illustration of the cross-sectional fragmentary view of the shoulder strap attached to body armor of one embodiment of the concealed shoulder strap of the present invention.
Figure 7:
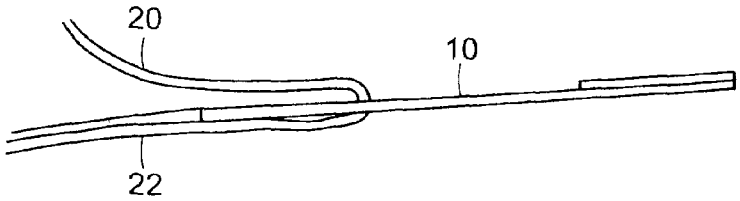
FIG. 7 is an illustration of the cross-sectional fragmentary view of the shoulder strap attached to body armor of another embodiment of the concealed shoulder strap of the present invention.

In one embodiment of the present invention, the shoulder straps 10 are concealed and include complete adjustability within the outer shell shoulder. FIGS. 5, 5A and 6 are illustrations of this embodiment. FIGS. 6 shows that the shoulder strap 10 is indirectly attached to ballistic panel 15 by stitching 12 through ballistic panel 15 and suspension tabs 14A and 14B. The suspension tabs 14A and 14B are stitched to the ballistic panel 15 at a shoulder region of the ballistic panel (e.g., right shoulder region 23 and left shoulder region 24). The suspension tabs 14A and 14B may be one portion of a hook and loop fastener (i.e. the hook portion). The shoulder strap 10 may include the mating portion of the suspension tabs (i.e., the loop porion). The shoulder strap 10 is sandwiched between the suspensin tabs 14A and 14B, providing the indirect attachment to the ballistic panel 15 and the adjustability. To adjust the shoulder strap 10 to a particular user, the user may cut the shoulder strap 10 to length, and then sandwich the proper length shoulder strap between the suspension tabs 14A and 14B. As such, the ballistic panel 15 is substantially prevented from shifting during wear and extreme conditions, while substantially eliminating the common problem of rolling and sagging, which is typically found in soft, flexible vests. FIG. 5 and 6 also illustrates that the suspension tabs 14A and 14B and the shoulder strap 10 is under outershell fabric 20. The shoulder strap 10 and outershell fabric 20 may lie in different positions, as shown by the dotted lines of FIG. 6. The shoulder strap 10 may be a neoprene loop system or elastic removable straps. FIG. 5A shows an embodiment of the present invvention on a user 100, with the front outershell 2 removed for clarity. FIG. 7 is an alternative embodiment where shoulder strap 10 is concealed by sandwiching the shoulder strap 10 between top outer layer 20 and middle layer of the outer shell 22.

In yet another embodiment, shoulder strap 10 is attached directly to the ballistics through the system disclosed in U.S. Pat. No. 4,989,266, wherein the disclosure is incorporated herein. In an alternative embodiment, shoulder strap 10 is attached by a system of a 4 part outer shell strap attachment system.

Figure 8:
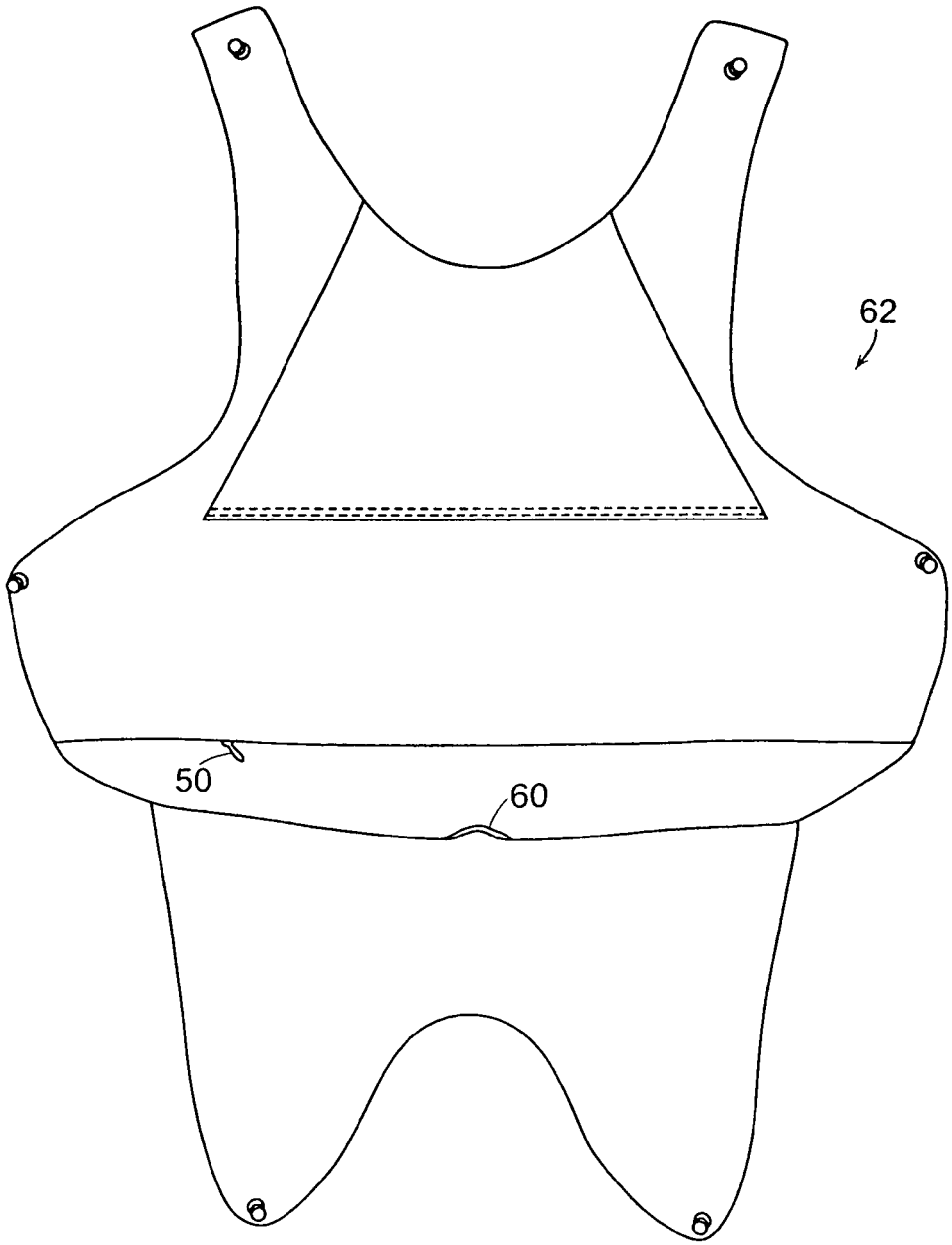
FIG. 8 is an illustration of the front view of one embodiment of the present invention.
Figure 8A:
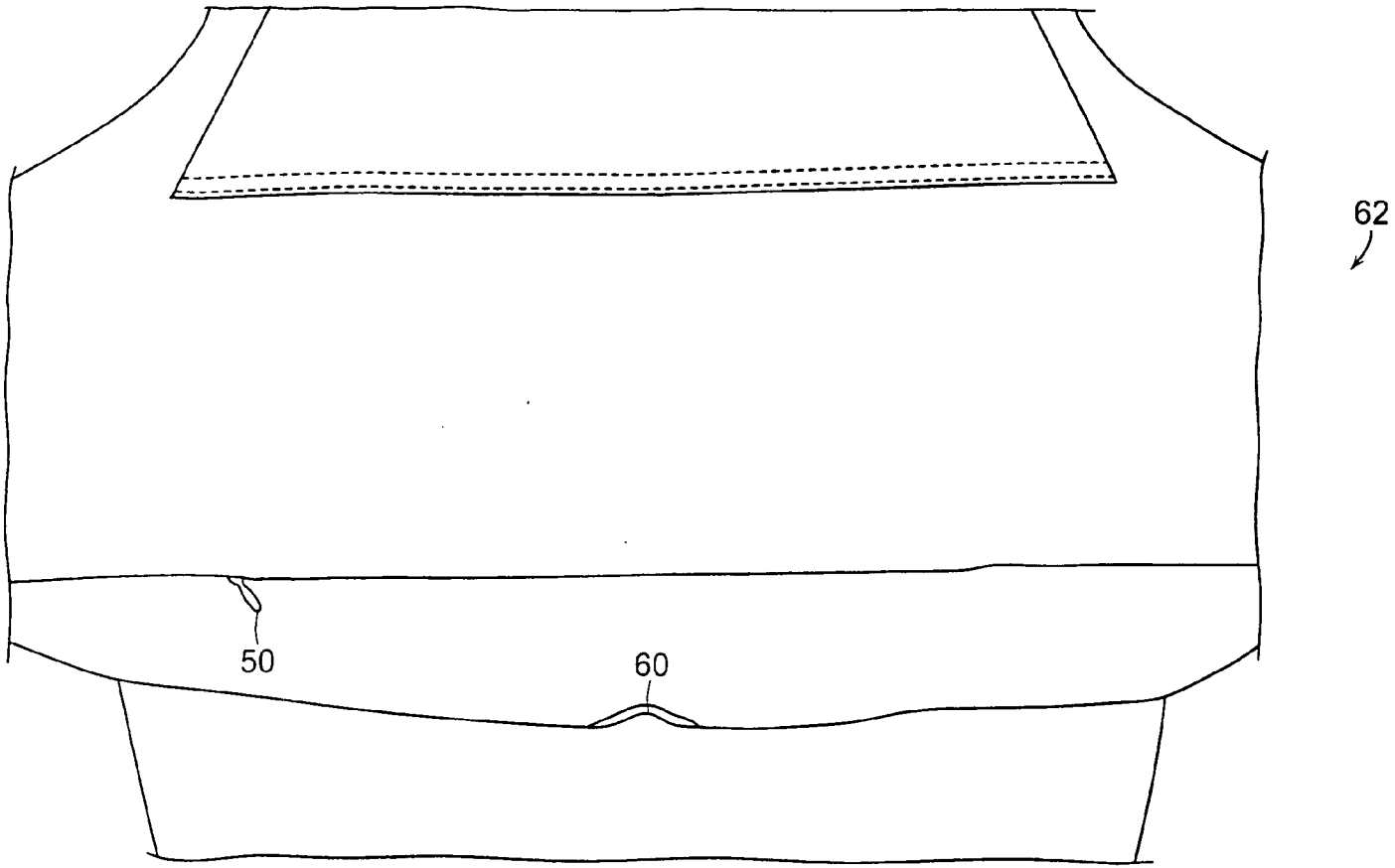
Figure 9:
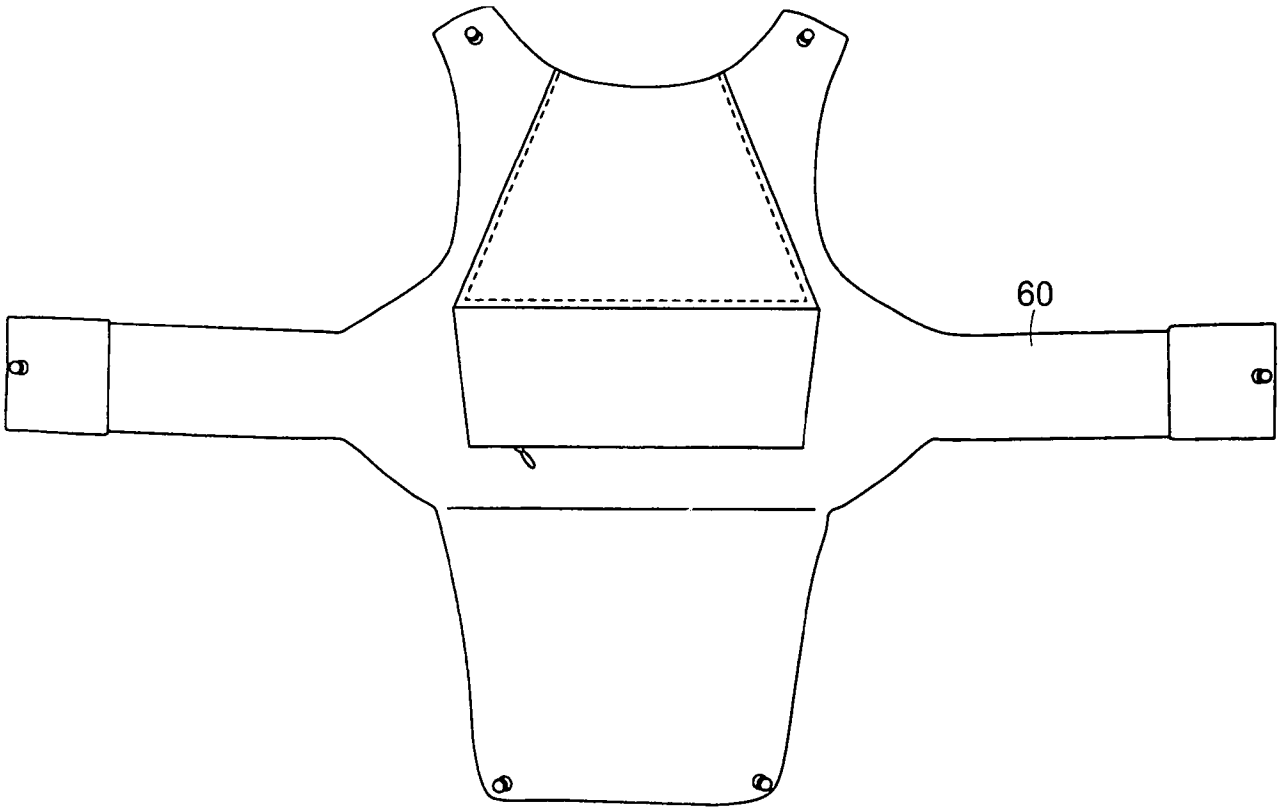
FIG. 9 is an illustration of the back view of one embodiment of the present invention.
Figure 10:
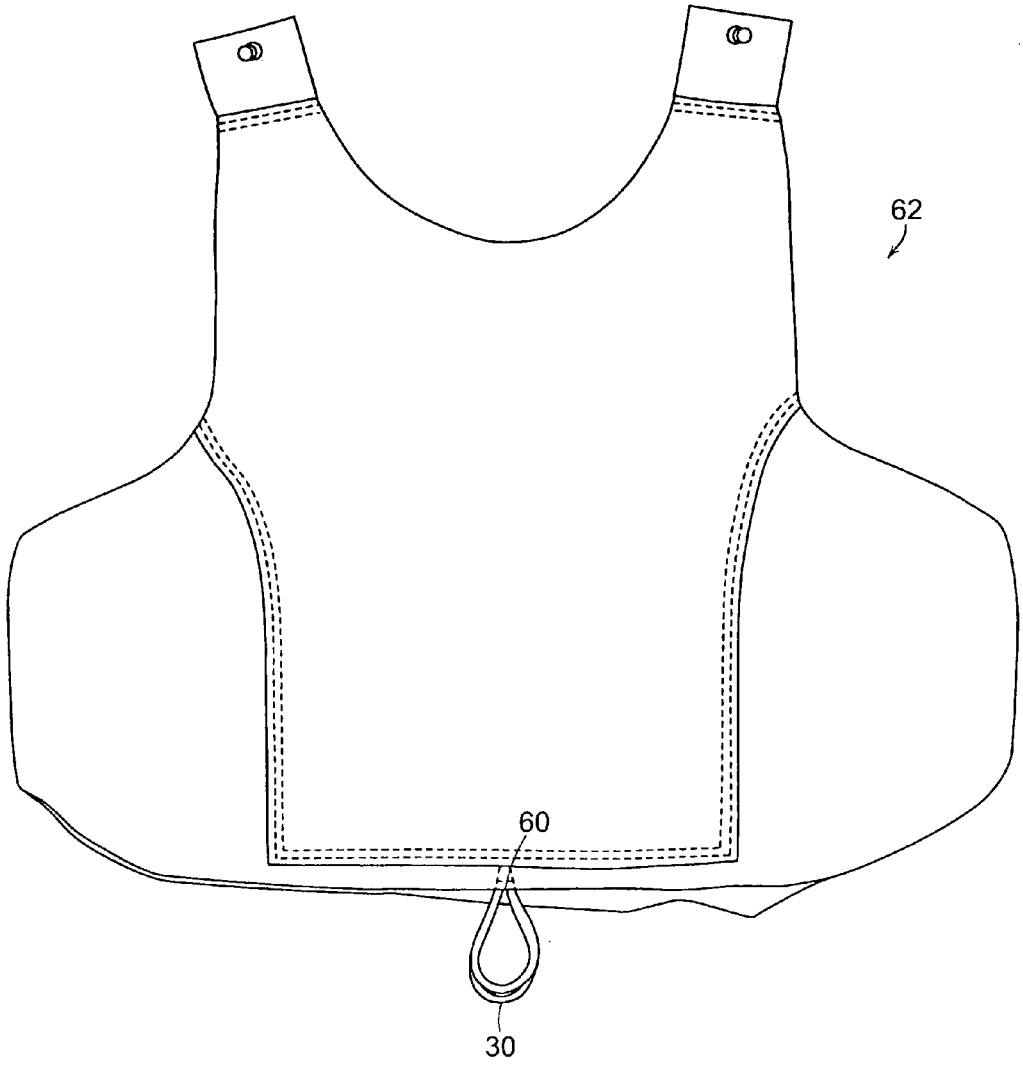
Figure 11B:
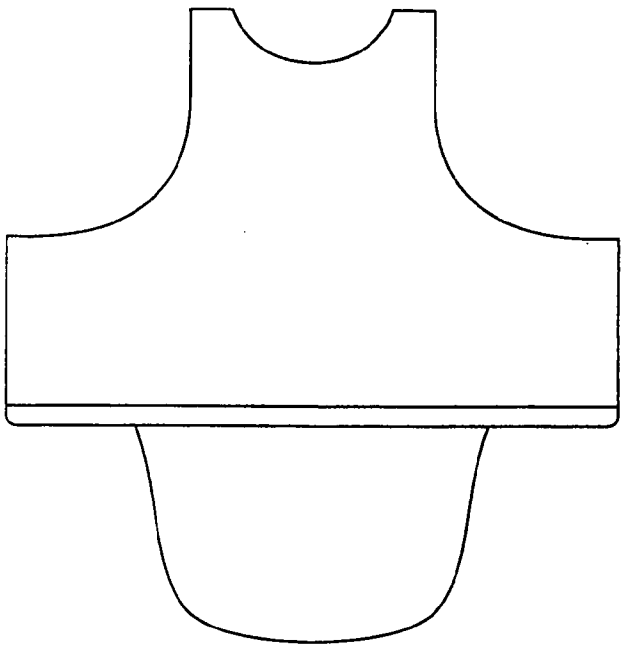
FIGS. 11A, 11B and 11C are illustrations of another embodiment of the present invention where
Figure 11A:
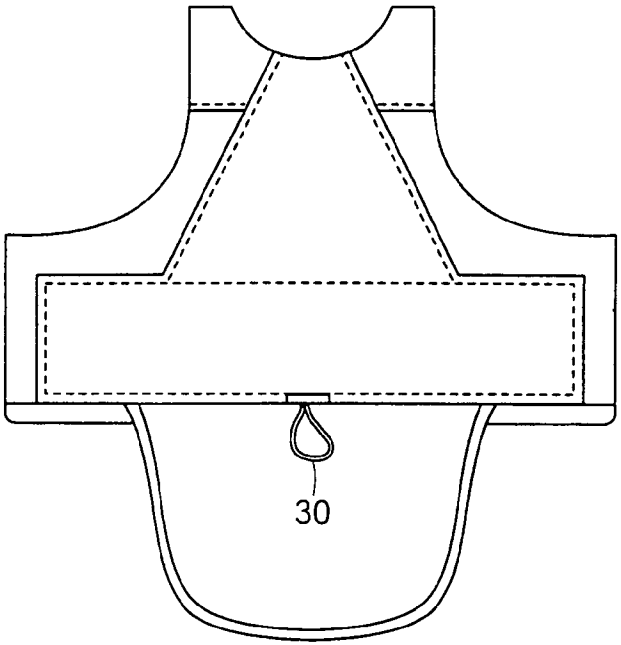
Figure 11C:
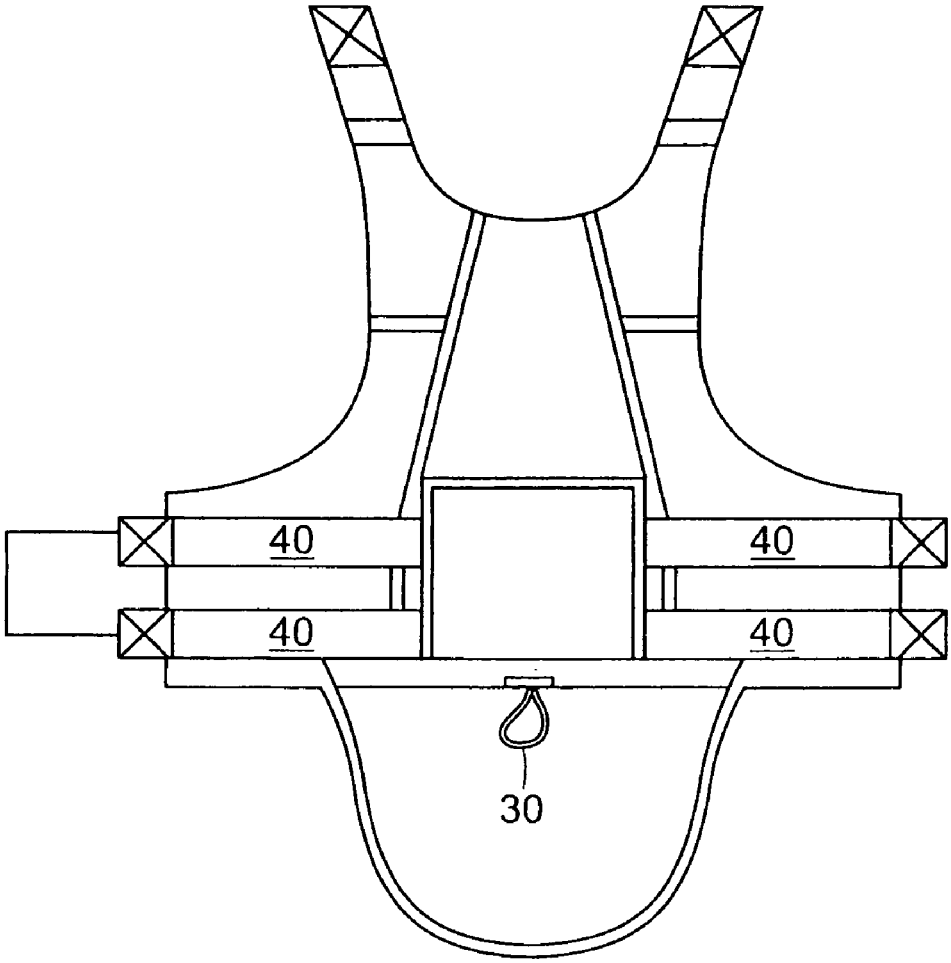

Referring to FIGS. 8-11C, in a further embodiment of the present invention, a stabilizer tab 30 is directly sewn to the ballistic panel so as to stabilize the ballistic panel against the body. FIGS. 8 and 8A show an embodiment for the opening 60 in front outeshell 62 for stabilizer tab 30 to pull through. FIG. 10 shows another view where stabilizer tab 30, is threaded through the front outer shell 62. In a further embodiment, FIGS. 11 A–C show direct attachment of stabilizer tab 30 to the ballistics.

As can be seen from FIGS. 8 through 11, the present invention provides better concealability.

Figure 12A:
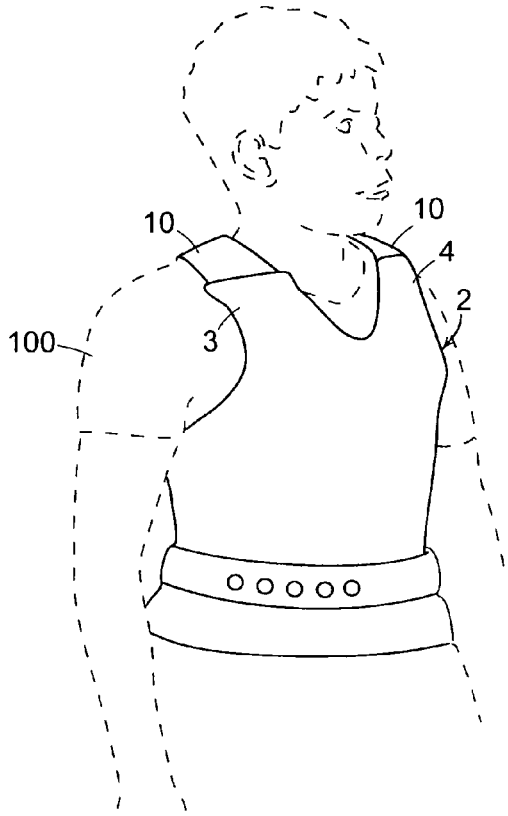
FIGS. 12A and 12B illustrations showing the front and back respectively of one embodiment of the present invention.
Figure 12B:
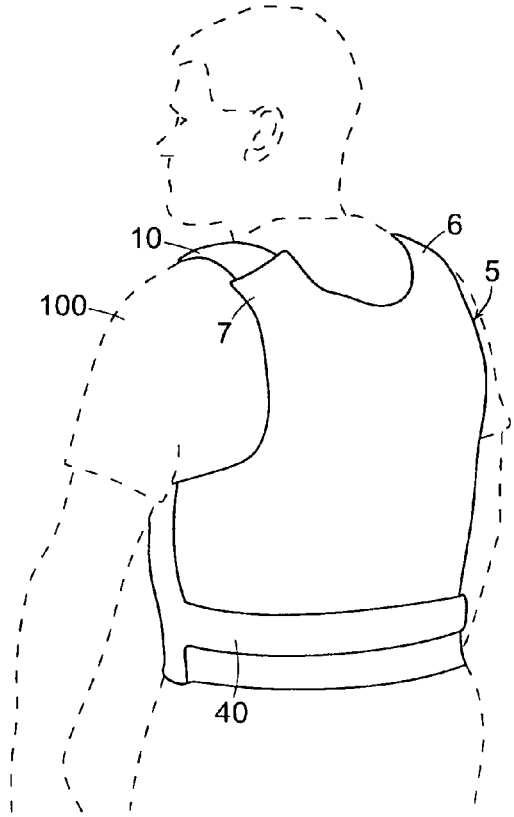

FIGS. 12A and 12B illustrate the adjustability of side straps 40 on both the front and back of the outer shell.

In yet another embodiment, the outershell is provide with a lining that has increased moisture wicking properties. An example of such lining is "Body Sensor" material. The outershell may be composed of a durable 65/35 poly/cotton material.

In yet a further embodiment, a smooth bi-directional stretch fabric is used on the front center to substantially prevent the uniform shirt from snagging on the fabric and to ensure comfort of the wearer.

In another embodiment, as illustrated in FIGS. 1A, 1B, 2A, 2B, 4A, 4B, 8A, 8B, 9A and 9B, geometric patterns are used to strengthen the seams.

In a further embodiment, topstitching is eliminated to provide a smoother finish and prevent chaffing against the wearer's body.

Figure 9A:
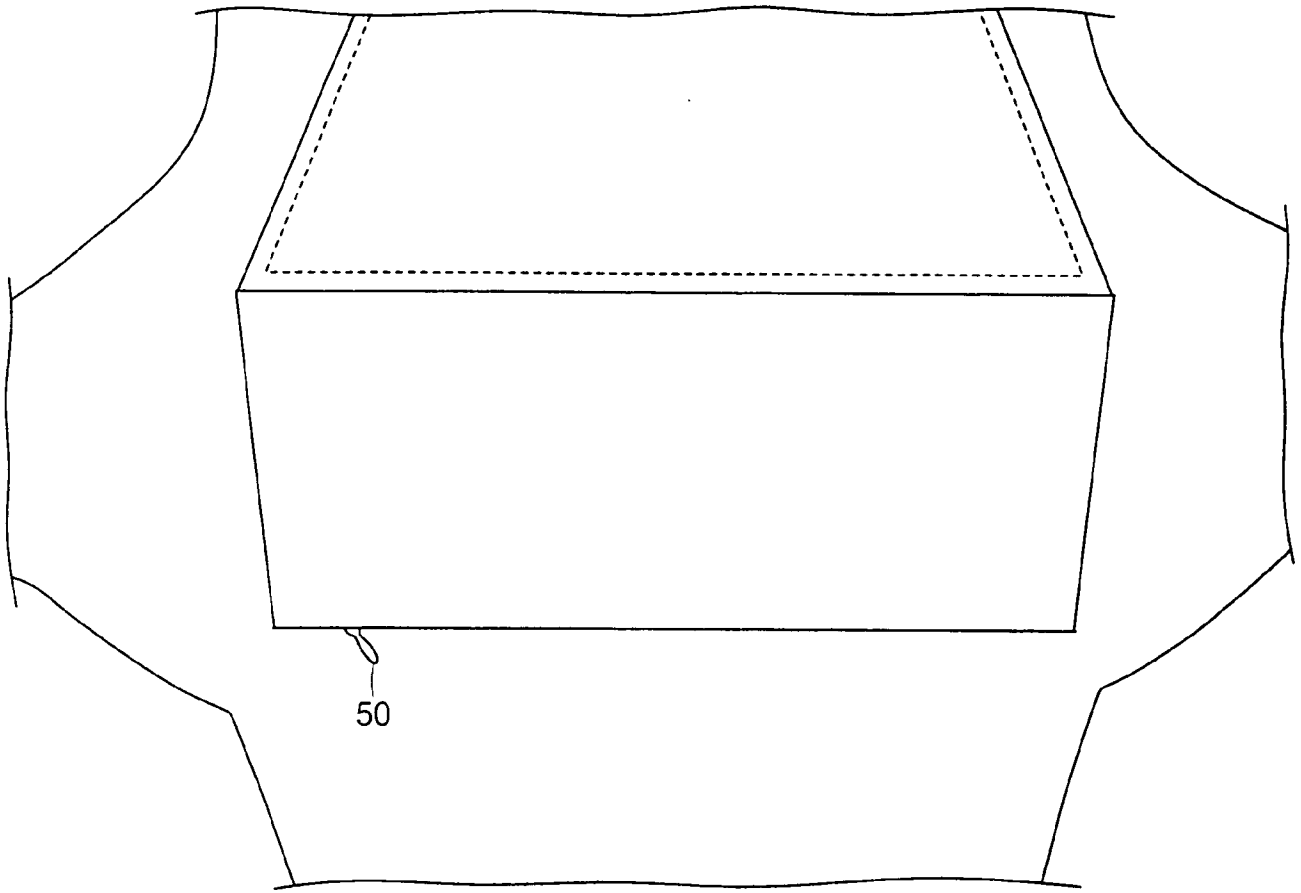
FIG. 9A is an illustration of the fragmentary view of FIG. 9 showing the hidden zipper.

In yet another embodiment, as illustrated in FIGS. 8, 8A and 9A, ballistics are inserted through the front via "hidden" zipper 50. Alternatively, ballistics may be inserted at the bottom to provide a smooth finish and better concealability.

In another embodiment, the positioning of loop fabric and design of straps allows adjustment to be made at an angle in an position.

In a further embodiment, as illustrated in FIG. 9, cumber band 60 can be attached to the inside of the outershall to provide additional security of the back section of the vest.

FIGS. 3A and 3B illustrate an embodiment having no seams or attachment points and thus, further concealing the body armor.

In yet another embodiment, the pockets on the ballistic panels are sufficiently sized for flexible trauma shields and anti-stab panels. For example, the pockets can be 5 inches by 8 inches and 8 inches by 8 inches.

What is claimed is:

1. A body armor system for protecting a user from penetration, comprising:

a front protective section for overlying the chest region of the user;

a rear protective section for overlying the back of the user;

a flexible right shoulder strap and a flexible left shoulder straps fastened to right and left shoulder regions, respectively, of the rear section, wherein the straps extend over the right and left shoulders of the user for attachment to corresponding right and left portions of the front section;

an outershell, the outershell includes a shoulder area;

wherein the shoulder straps are at least partially hidden within the outershell shoulder area, wherein the shoulder straps include means for adjusting within the outershell shoulder area, and wherein each of the shoulder straps is indirectly attached to a front ballistic panel by stitching through the front ballistic panel and at least one suspension tab at the right shoulder region of the front ballistic panel and at least one suspension tab at the left shoulder region of the front ballastic panel, the right shoulder straps being by at least of hook and loop material to the at least one suspension tab at the right shoulder region of the front ballastic panel and the left shoulder straps being by at least of hook and loop material to the at least one suspension tab at the left shoulder region of the front ballistic panel; and wherein a stabilizer loop is directly sewn to the ballistic panel to stabilize the ballistic panel against the user's body.

2. The body armor system of claim 1, further comprising:

a hidden zipper in the front protective section where the ballistic panel is inserted.

3. The body armor system of claim 1, further comprising:

a slit in a bottom of the front protective section where the ballistic panel is inserted.

4. The body armor system of claim 1, further comprising:

a cumber band attached to an inside of the outershell to provide additional security to the rear section.

5. The body armor system of claim 1, further comprising:

the front protective section having substantially no seams or attachment points.

6. The body armor system of claim 1 wherein the pair of flexible right and left shoulder straps are indirectly attached to a rear ballastic panel in the rear protective section by stitching through the rear ballastic panel and at least one suspension tab at the right shoulder region of the rear ballastic panel and at least one suspension tab at the left shoulder region of the rear ballistic panel, the right shoulder straps being removably attached to the at least one suspension tab at the right shoulder region of the rear ballistic panel and the left shoulder straps being removably attached to the at least one suspension tab at the left shoulder region of the rear ballistic panel.

* * * * *